US006363554B1

(12) United States Patent
Brown

(10) Patent No.: US 6,363,554 B1
(45) Date of Patent: Apr. 2, 2002

(54) HEAD HUGGING PILLOW CASE

(76) Inventor: Julia A. Brown, P.O. Box 601, Saunderstown, RI (US) 02874-0601

( * ) Notice: Subject to any disclaimer, the term of this patent is extended or adjusted under 35 U.S.C. 154(b) by 0 days.

(21) Appl. No.: 09/668,809

(22) Filed: Sep. 22, 2000

(51) Int. Cl.[7] ..... A47G 9/00
(52) U.S. Cl. ..... 5/490; 5/636
(58) Field of Search ..... 5/636, 640, 490, 5/493, 494, 420, 419

(56) References Cited

U.S. PATENT DOCUMENTS 1,380,480 A * 6/1921 Jennings ..... 5/490
2,412,769 A * 12/1946 Easterbrooks ..... 5/490
2,413,828 A * 1/1947 Hirsh et al. ..... 5/490
5,572,753 A * 11/1996 Ruscitto ..... 5/490

* cited by examiner

*Primary Examiner*—Lynne H. Browne
*Assistant Examiner*—Fredrick Conley
(74) *Attorney, Agent, or Firm*—Cristina M Offenberg

(57) ABSTRACT

A head hugging pillow case including a ruffled extension which provides warmth to the head and shoulders while sleeping. The ruffled extension can be easily shaped to cover the head, face, neck and/or ears for maximum warmth and breathability. The ruffled extension can also be flipped over the top of the pillowcase when not needed for extra warmth. The ruffled extension also provides a light shield for one's eyes during sleep or resting time.

7 Claims, 2 Drawing Sheets

HEAD HUGGING PILLOW CASE

FIELD OF THE INVENTION

The present invention relates to pillow cases. Specifically it concerns one which in addition to its usual function as a pillow cover also serves as a covering providing warmth for the head and shoulders.

BACKGROUND

Traditionally, pillow cases have been made using two generally rectangular panels of fabric material enclosed along both long sides and along one of the narrow sides with the remaining side open so as to receive a generally rectangular pillow. Although this type of pillow case has been in use for a considerable length of time, it provides neither head protection from cold temperatures and drafts nor light shielding. Persons who experience head chills while sleeping would benefit from a product that could serve as both a pillowcase and head warmer. It is well known that loss of body heat is rapid through the unprotected scalp. Persons who enjoy certain recreational activities such as outdoor camping, recreational vehicle users and boat owners experience cold heads because, traditionally, the head of the beds in a recreational vehicle and boat are usually on an outside wall and exposed to cold and drafts. Additionally, patients of medical treatments who suffer from hair fall-out resulting in full or partial baldness may also experience a cold head. Similarly, those with normal hair loss or baldness may suffer from the same discomfort. Therefore, there is a need for a head hugging pillow case that provides warmth to the entire head and also to the ears, shoulders and neck so as to prevent heat loss during sleep. Persons with migraine headaches often seek light shielding and warmth in an effort to ease pain. Other persons can sleep better when the light is shielded from their eyes. Traditional bed sheets and blankets are warm but are not intended to cover the head because by so doing can cause a suffocating condition.

Earlier attempts to solve this head warming problem include caps and kerchiefs which tend to fall off the head while sleeping and do not provide warmth to the shoulders and neck. Another attempt at a solution was a therapeutic pillow as described in U.S. Pat. No. 3,840,918 but this is an awkward apparatus to sleep with at night. Some patents exist which provide a pillow case with an extension of the pillow case draping over the face as seen in U.S. Pat. Nos. 1,380,480 and 5,572,753. These types of extensions do not easily stay over the head and shoulders while sleeping in bed as they are designed with material that is the same length as the long side of the pillowcase and the extension which tends to be displaced from the face during natural movements while sleeping. The inventions described in U.S. Pat. Nos. 2,412,769, 2,413,828, 5,127,117, and 4,420,847 attempt to solve the problem of displacement by attaching the sides of the extension to the sides of the pillow case. However, there is a serious issue with suffocation as the head is placed within this envelope of material. Additionally, depending on the design of the extension, it could be extremely confining and uncomfortable due to the fact that the sides are attached to a pillow. Furthermore, the extensions as described in patent '769, patent '117, and patent '847 do not cover the complete head and do not cover the shoulders or neck to provide the necessary warmth to a person who suffers from head chills. They also do not leave freedom of movement during sleep as the head is encased in an envelope of material. The prior art patents do not make any consideration for the differences in bed pillow size and fullness nor for differences in people's head size. It would be desirable to have a head covering pillow case that provides warmth and acts as a light shield while being effective on all types of bed pillows and for all sizes of people.

SUMMARY OF THE INVENTION

The present invention provides an improved pillow case providing additional warmth for the head and shoulders. The present invention which is a head hugging pillow case provides warmth and shields unwanted light to any user no matter the size of their head, and it is effective with all sizes and thicknesses of conventional bed pillows. The present invention uses a ruffled extension attached to the top edge of the long side of the pillow case. It provides warmth to the entire head as well as allows the user to shape the ruffled extension to cover just the ears or neck or shoulders alone. It also serves the purpose of shading light from a person while sleeping or resting. The present invention is comprised of a typical pillow case, rectangular in shape with a ruffled extension of material attached to the top edge of the long side of the pillow case. The ruffled extension is made of piece of material that is significantly longer in size (approximately two times the length of the standard pillow case) which is then gathered to fit the length of one long side of the pillow case thereby creating the "ruffle". The ruffle has a fullness to it that allows a person to shape it over their head or to keep just the ears, neck or shoulders warm. The gathers of the ruffle prevent displacement of the extension during sleep as there is enough material to allow for movement of the head so that the ruffle extension stays in place. The ample fullness of the ruffled extension prevents any suffocation issue and makes it more breathable than the prior art extensions because a pocket of airspace can be created for the nose or mouth to be exposed or just loosely covered. The sides of the ruffled extension are not sewn to the sides of the pillowcase and this provides an advantage over the prior art because it allows for movement and placement of the ruffled extension where needed or not needed. It is the best mode to make the pillow case of the subject invention from flannel material due to its flexibility and breathability. Additionally, traditional bed sheeting tends to be cool and flannel material is not. The inventor has tested many materials and has determined that a light weight, flexible, and breathable material is most suitable for the ruffled extension. Another advantage of the present invention is that the pillowcase can be used on either side of the bed and still have the open end of the pillow case facing outward from the bed which is the proper way to make a bed. The ruffled extension can be flipped over to either side of the pillow case. Additionally, when the head hugging pillow case is not in use, the ruffled extension can be flipped to the back side of the pillow case so as not to be seen.

DETAILED DESCRIPTION OF THE DRAWINGS

Figure 1:
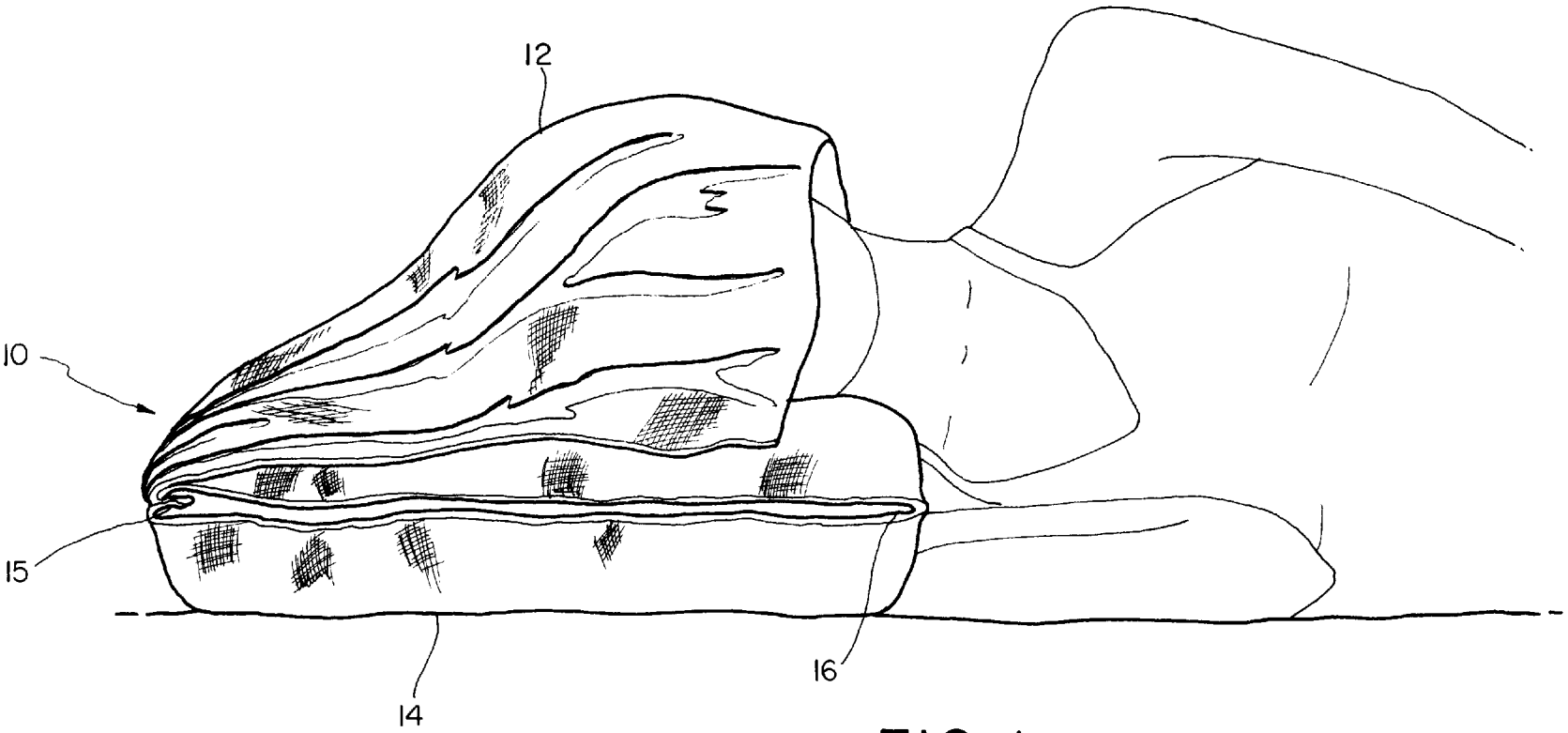
FIG. 1 is a side view of the head hugging pillow case shown in use by a sleeping person.

The drawings illustrate a head hugging pillow case (10) with a ruffled extension (12). The pillow case (14) is a traditional pillow case with two short sides and two long sides fitted for a bed pillow. The ruffled extension (12) is approximately two times the length of the pillow case's (14) top long side (15). The ruffled extension (12) is sewn inside the top long side (15) of the pillow case (14) between the two layers of the pillow case material. FIG. 1 illustrates the head hugging pillow case (10) in use by a person who can be of any size and with any size conventional pillow, no matter its fullness. The head of the sleeping person is placed on the pillow case (14) with the ruffled extension (12) placed over the head and shoulders and neck, if desirable. The user can shape and place the ruffled extension (12) over the desired body parts as the fullness in the ruffled extension (12) allows for variety.

Figure 2:
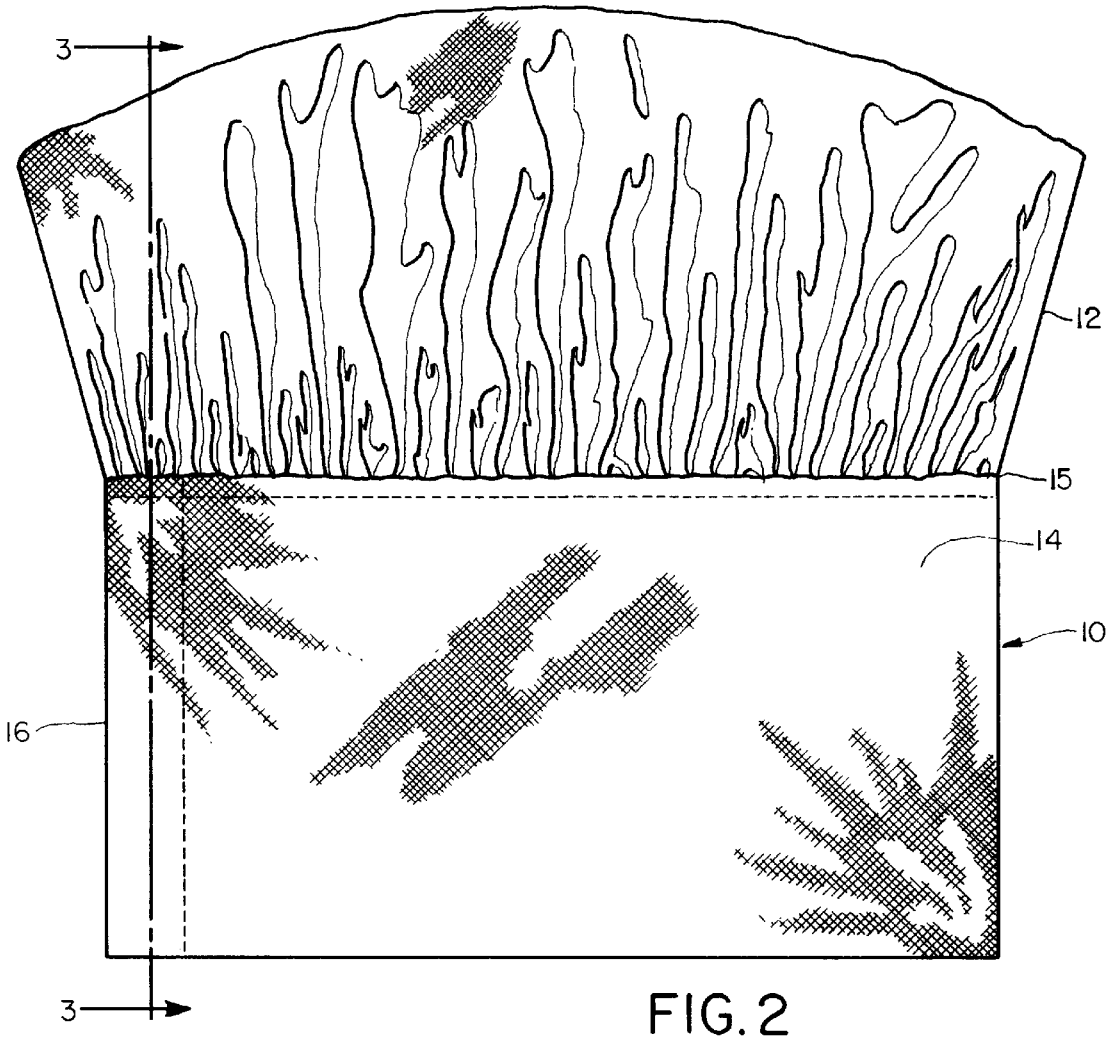
FIG. 2 is top view of the head hugging pillow case with the ruffled extension shown extended outward from the pillow case.

As shown in FIG. 2, the ruffled extension (12) is created when the width of the ruffled (12) extension is gathered at the open edge and sewn to fit into the length of the pillow case (14). FIG. 2 illustrates the construction of the head hugging pillow (10). The pillow case (14) is one constructed of a large piece of fabric wherein one short edge is folded over with the right side down to make a hem (16) and then stitched. The ruffled extension (12) is constructed of one large relatively rectangular piece of fabric that is folded in half lengthwise with the right sides together and sewn at both short ends. The ruffle extension (12) is then turned rightside out and gather along the open long edge. The pillow case (14) is laid out with the right side up. Then the gathered ruffled extension is layered along the top edge of the pillowcase on the right side of the material and then bottom edge of pillowcase is pulled up and over the ruffle, (enclosing ruffle inside). On the pillow case, the short edge without the hem is sewn closed. Next, the long edge of the pillowcase is sewn (which will be four layers of fabric—two layers of ruffle in between both sides of pillowcase). The entire head hugging pillowcase is then turned right side out.

Figure 3:
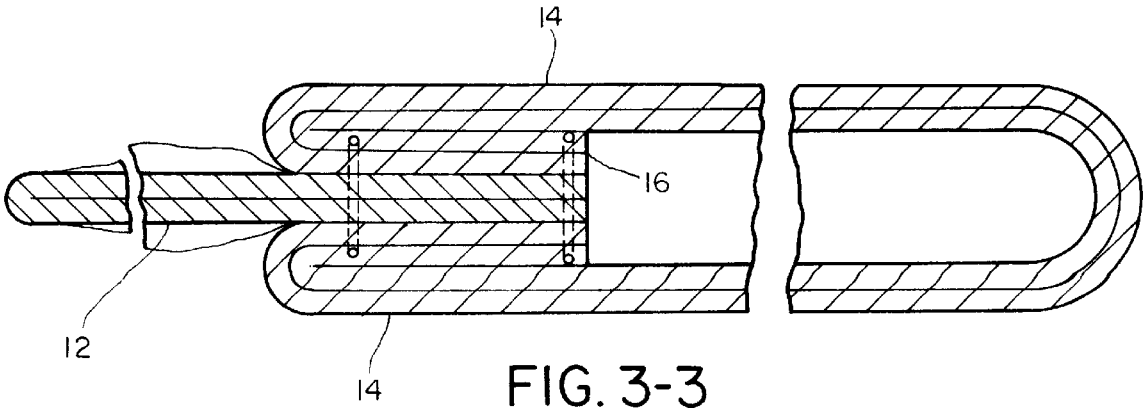
FIG. 3 is a cross sectional view of the head hugging pillow case showing the area where the extension is sewn into the pillow case.

FIG. 3 illustrates a cross sectional view of FIG. 2 along the line 3—3. The double layered ruffled extension (12) is sewn in between the two layers making up the pillow case (14). The ruffled extension (12) is a piece of material approximately two times the length of the long end of the pillow case (14). It is gathered to form the ruffle and sewn in between the two pieces of the pillow case (14) to fit into the length of the long end of the pillow case before the entire head hugging pillowcase (10) is turned rightside out. As shown the pillow case (14) edge is the open edge with the hem so that the pillow case sides are folded over.

What is claimed is:

1. A head hugging pillow case made from a first piece of substantially rectangular shaped fabric material, the long dimension of said first fabric material divided along a bisecting line into substantially equal halves thereby creating near mirror image segments with an open long edge and the first short edge is sewn and second short edge remains open; a second piece of substantially rectangular shape fabric material, the long dimension of said second fabric material divided along a bisecting line into substantially equal halves thereby creating near mirror image segments and a long open edge, wherein the second fabric material is gathered closing its open edge to be the same length of the first fabric material and wherein the second fabric material is joined at its open edge to the open edge of the first fabric material to form a ruffled extension.

2. A head hugging pillow case as claimed in claim 1 wherein the material used in construction is a light weight and breathable material.

3. A head hugging pillow case as claimed in claim 1 wherein the material used in construction is flannel.

4. A head hugging pillow case as claimed in claim 1 wherein the ruffled extension provides warmth to the user by placing the ruffled extension over the user's head.

5. A head hugging pillow case as claimed in claim 1 wherein the ruffled extension provides a light shield when the ruffled extension is placed over a user's eyes.

6. A head hugging pillow case as claimed in claim 1 with a hem sewn at one short side to hold a pillow inside the pillowcase.

7. A method of making a head hugging pillow case including the steps of:

taking a first relatively rectangular piece of fabric having a top edge, bottom edge, and two long sides;

folding a small part of one long side over so the right side is down;

stitching said folded over long side to make a hem;

taking a second large relatively rectangular piece of fabric;

folding said second piece of fabric in half lengthwise with the right sides together creating a top open edge, two short sides and a closed bottom edge;

sewing both short sides of said second piece of fabric;

turning the sewn second piece of fabric rightside out;

gathering the fabric along the top open edge of the second piece of fabric making a ruffled extension;

laying out the first piece of fabric with the right side up;

laying said ruffled extension along the top edge of the first piece of fabric on the right side of the fabric;

pulling the bottom edge of the first piece of fabric and folding up and over the ruffled extension thereby enclosing the ruffled extension inside the first piece of fabric;

sewing the second long side of the first piece of fabric in half;

sewing closed the top edge of the first piece of fabric creating a pillow case having two short edges, a top edge with the ruffled extension sewn within the top edge and a bottom edge;

turning the pillowcase right side out.

* * * * *

UNITED STATES PATENT AND TRADEMARK OFFICE

CERTIFICATE OF CORRECTION

PATENT NO. : 6,363,554 B1
DATED : April 2, 2002
INVENTOR(S) : Brown

It is certified that error appears in the above-identified patent and that said Letters Patent is hereby corrected as shown below:

Title page,
Item [*] Notice, delete the phrase “by 0 days” and insert -- by 4 days --

Signed and Sealed this

Twenty-eighth Day of September, 2004

JON W. DUDAS
*Director of the United States Patent and Trademark Office*